United States Patent [19]

Ogi et al.

[11] Patent Number: 4,863,838

[45] Date of Patent: Sep. 5, 1989

[54] DIRECT POSITIVE TYPE LIGHT-SENSITIVE SILVER HALIDE PHOTOGRAPHIC MATERIALS

[75] Inventors: Keiji Ogi; Yasuo Tosaka, both of Hino, Japan

[73] Assignee: Konishiroku Photo Industry Co., Ltd., Tokyo, Japan

[21] Appl. No.: 188,647

[22] Filed: May 2, 1988

Related U.S. Application Data

[63] Continuation of Ser. No. 21,612, Mar. 2, 1987, abandoned, which is a continuation of Ser. No. 779,300, Sep. 23, 1985, abandoned, which is a continuation of Ser. No. 670,356, Nov. 9, 1984, abandoned, which is a continuation of Ser. No. 559,837, Dec. 8, 1983, abandoned, which is a continuation of Ser. No. 298,956, Sep. 3, 1981, abandoned, which is a continuation of Ser. No. 522, Mar. 21, 1980, abandoned.

[30] Foreign Application Priority Data

Mar. 26, 1979 [JP] Japan ..... 54-35361

[51] Int. Cl.[4] ..... G03C 1/485

[52] U.S. Cl. ..... 430/378; 430/564; 430/567; 430/409

[58] Field of Search ..... 430/409, 564, 567, 378

[56] References Cited

U.S. PATENT DOCUMENTS

| | | | |
|---|---|---|---|
| 2,563,785 | 8/1951 | Ives | 430/409 |
| 2,592,250 | 4/1952 | Davey et al. | 430/569 |
| 3,206,313 | 9/1965 | Porter et al. | 430/564 |
| 3,317,322 | 5/1967 | Porter et al. | 430/567 |
| 3,367,778 | 2/1968 | Berriman | 430/411 |
| 3,761,266 | 9/1973 | Milton | 430/409 |
| 3,761,267 | 9/1973 | Gilman et al. | 430/409 |
| 3,850,637 | 11/1974 | Evans | 430/409 |
| 3,935,014 | 1/1976 | Klotzer et al. | 430/409 |
| 3,957,488 | 5/1976 | Gilman et al. | 430/409 |
| 4,070,190 | 1/1978 | Friedrich et al. | 430/567 |

*Primary Examiner*—Richard L. Schilling
*Assistant Examiner*—Janet C. Baxter
*Attorney, Agent, or Firm*—Jordan B. Bierman

[57] ABSTRACT

A direct positive photographic material having a support and a silver halide emulsion layer thereon contains internal latent image type silver halide grains. These grains have a core/shell structure and have not been previously fogged. Each grain comprises a conversion type silver halide core and a silver halide shell over the core.

The layer would produce, when exposed for a given time upto one second and developed at 20° C. for 4 minutes with a certain internal developing solution, a maximum density which is at least five times that obtained when the layer is similarly exposed and developed with a particular surface developing solution.

5 Claims, No Drawings

DIRECT POSITIVE TYPE LIGHT-SENSITIVE SILVER HALIDE PHOTOGRAPHIC MATERIALS

This application is a Continuation of application Ser. No. 21,612, filed Mar. 2, 1987, now abandoned, which is a Continuation of application Ser. No. 779,300, filed Sept. 23, 1985, now abandoned, which is a continuation of Ser. No. 670,356, filed Nov. 9, 1984, now abandoned; which is a continuation of Ser. No. 559,839, filed Dec. 8, 1983, now abandoned; which is a continuation of Ser. No. 298,956, filed Sept. 3, 1981, now abandoned; which is a continuation of Ser. No. 132,522, filed Mar. 21, 1980, now abandoned; which claims the priority of Japanese Application No. 35361/1979, filed Mar. 26, 1979.

This invention relates to direct positive type light-sensitive silver halide photographic materials and more particularly to photographic materials having a support and thereon at least one internal latent image type silver halide emulsion layer, which photographic materials are capable of forming thereon direct positive images when subjected, after imagewise exposure, to overall exposure before and/or during surface development or to surface development treatment in the presence of fogging agents.

The present invention has successfully achieved an advanced technique that is also applicable to the color diffusion transfer process in addition to ordinary black-and-white photography as well as common color photography. It is well known that a direct positive image can be obtained by the use of a light-sensitive silver halide photographic material without requiring any intermediate treatment processes or formation of a nagative photographic image.

Processes, which are employed in forming positive images by the use of conventionally known direct positive type light-sensitive silver halide photographic materials, may be classified, with the exception of special cases, into two major types when taken into account their practical usefulness.

In a process clasified as belonging to one of the two types, silver halide emulsion which has previously been fogged is used and fog nucleus (latent image) at the exposed portion is destroyed by the utilization of solarization or Herschel effect to yield a positive image.

In a process classified as belonging to the other of the two types, a silver halide emulsion of internal latent image type, which has not been fogged is used and, subsequent to imagewise exposure, surface development is effected after and/or during fog treatment to yield a positive image. The above fog treatment may be effected by applying overall light-exposure, by using a fogging agent, by using air fogging technique by blowing air into developing solutions, by using strong developing solution or by effecting heat treatment, but a method comprising utilization of light or a fogging agent is adopted. The internal latent image type silver halide photographic emulsions as referred to above are intended to designate such silver halide photographic emulsions as having photosensitive nuclei primarily within the silver halide grains and forming latent images within the silver halide grains by exposure.

Compared with the process of the former type, the process of the latter type is suitable for applications where high sensitivity is required because the sensitivity obtainable thereby is generally higher and the present invention relates to photographic materials capable of forming positive images according to the process of the latter type.

In the field of this art, there have heretofore been known a variety of arts adaptable therefor. For instance, leading known techniques are those as disclosed in U.S. Pat. Nos. 2,592,250, 2,466,957, 2,497,875, 2,588,982, 3,761,266, 3,761,276 and 3,796,577, and British Patent Specification No. 1,151,363.

According to the above-mentioned known processes, there can be prepared light-sensitive photographic materials with relatively high sensitivity, considering that the thus prepared photographic materials are of the direct positive type.

It cannot be said positively that a definite explanation has been given so far on the details of mechanism of forming direct positive images. However, the process of forming positive images can be understood to a certain extent, for example, from the discussion on "Internal-Image Desensitization" by C. E. K. Mees and T. H. James, "The theory of the Photographic Process," 3rd Edition, p. 161.

Thus, it is considered that fog nuclei are selectively formed only on the surface of unexposed silver halide particles by the surface desensitization action caused by the so-called internal latent images formed in the inside of silver halide particles by virtue of the initial imagewise exposure and then photographic images are formed by ordinary development in the unexposed portions.

Various types of silver halide photographic emulsions have heretofore been known as the internal latent image type silver halide emulsions as referred to above.

Conversion type silver halide emulsions disclosed in U.S. Pat. No. 2,592,250 may be relatively easily prepared by converting a silver halide which is more soluble into the corresponding silver halide which is less soluble, and direct positive images can be formed according to the previously mentioned process by the use of said emulsions.

Where light-sensitive photographic materials comprising such silver halide emulsions as referred to above are intended to be used for a variety of purposes in the field of photography, however, it is still desired that photographic characteristics of said emulsions be further improved in photographic characteristics so as to attain an increased sensitivity, lower minimum density (D min) and higher maximum density (D max).

Higher sensitivities as desired above may be attained in the photographic emulsions by the use of core/shell type emulsions as disclosed in U.S. Pat. Nos. 3,761,266 and 3,761,276, wherein chemical sensitization nuclei or polyvalent metal ions have been doped in the inside of silver halide grains. In the emulsions of this kind, however, it is an indispensable requirement to apply chemical ripening treatment to a certain extent to the surface of silver halide particles in order to make improvements in density (D max) of the resulting images. Accordingly, there is need of carrying out such surface chemical ripening treatment under accurately controlled conditions in order to prevent an excess in ripening, and it is also very difficult to stabilize the silver halide emulsions of the type when they are intended to be stored for an prolonged period of time. Thus the use of such emulsions is very disadvantageous from a practical point of view. In preparing the silver halide emulsions which have layered-grain structure as disclosed in U.S. Pat. Nos. 3,935,014 and 3,957,488, it is necessary to control PAg of the emulsions in the precipitation process of silver halide which is used as a core or which is to be laminated on the core. Moreover, the emulsions herein prepared must contain silver halide particles of large grain size in order to attain high sensitivities comparable to those for photographing purposes, and it takes a long period of time to prepare such emulsions. For that reason, it should be said that difficulties are involved in putting the emulsions to practical use. For instance, there is need of a mixing apparatus equipped with a special automatic control device for preparing the emulsions of this kind on a commercial scale with the result that a disadvantage from the standpoint of manufacturing costs is unavoidable.

Thus the advent of internal latent image type silver halide emulsion having further improved photographic characteristics (e.g. sensitivity, D max, D min, etc.) and capable of being prepared with great ease in a short time and in a stable manner is a desideratum for bringing the direct positive type light-sensitive photographic materials based on this process to practical use.

Accordingly, an object of the present invention is to provide direct positive type silver halide photographic emulsions with improved photographic characteristics, such as high sensitivity, high maximum density and low minimum density, and with favorable stability and capable of being prepared in an easy and efficient manner.

Another object of the present invention is to provide black-and-white as well as color photographic materials and photographic materials for the color diffusion transfer process, which materials each have a support and thereon at least one layer comprising such silver halide emulsion as set forth in the above-mentioned object of the present invention and having further improved photographic characteristics.

As a result of extensive researches conducted this time by the present inventors, it has been found that in a light-sensitive photographic material having a support and thereon at least one layer formed by coating a silver halide emulsion comprising internal latent image type silver halide particles, from which photographic material a direct positive image is obtained by subjecting said material, after imagewise exposure, to overall exposure before and/or during surface development or to surface development treatment in the presence of a fogging agent, the above-mentioned objects of the present invention can be accomplished by means of the internal latent image type silver halide emulsion containing grains having a core/shell type structure, wherein each grain comprises a conversion type silver halide core and a silver halide shell having covered over said core and is not previously fogged on its surface.

By conversion type silver halide cores as used in the internal latent image type silver halide emulsions of the present invention are meant silver halide particles which may be prepared by forming an emulsion comprising at least a part of silver salt grains of being more soluble in water than silver bromide and then converting at least a part of the grains of said emulsion into silver bromide and silver iodobromide. The conversion type silver halide core-emulsion may usually prepared with ease by mixing an aqueous silver nitrate solution in the presence of a protective colloid, such as gelatine, with an aqueous chloride solution and incorporating the resulting silver chloride emulsion with an aqueous bromide solution. The conversion type silver halide core grains used in the present invention preferably contains at least 80 mols % of silver bromide and may contain less than 10 mols % of silver iodide. More preferable are the conversion type silver halide cores which contain particularly at least 90 mols % of silver bromide and less than 5 mols % (including 0 mols %) of silver iodide and the remainder halide as silver chloride.

The silver halide grain of the core/shell structure according to the present invention is a grain of such a structure as obtained by the formation of a silver halide shell by precipitating a silver halide on the surface of the aforesaid conversion type silver halide core grain. The silver halide used for forming the shell in accordance with the present invention may be any of silver chloride, silver bromide, silver chlorobromide, silver iodobromide and silver chloroiodobromide.

The amount of the silver halide of the shell when expressed in terms of content of silver halide is preferably in the range of 30 to 50 mols % based on the sum total of silver halides constituting the core and the shell. In case the silver halide content of the shell is less than 30 mols %, storage stability of the emulsion containing the resulting silver halide core/shell grains becomes poor under high temperature circumstances, resulting in increase of the minimum density and, on the other hand, the maximum density of the resulting positive image decreases if the silver halide content exceeds 50 mols %.

It is preferable that the internal latent image type silver halide grains of the present invention are not chemically sensitized on the particle surface, or to a slight extent even if they are chemically sensitized on the grain surface.

The meaning that the grain surface is not previously fogged is that in case a specimen prepared by coating the emulsion used in the present invention on a transparent film support has been developed, without exposure, at 20° C. for 10 minutes with the under-mentioned surface developing solution A, the density obtained thereby is 0.6, preferably not greater than 0.4.

| Surface developing solution: | |
|---|---|
| Methol | 2.5 g |
| l-Ascorbic acid | 10 g |
| $NaBO_2.4H_2O$ | 35 g |
| KBr | 1 g |
| Water to make | 1 liter |

In this connection, the silver halide emulsions of the present invention are capable of giving sufficient densities when specimens prepared by using the emulsions in the above manner are developed after exposure with an internal developing solution B as prescribed below.

| | |
|---|---|
| Methol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water to make | 1 liter |

Speaking more concretely, when one portion of the aforesaid specimen is exposed to light intensity scalewise for a given time up to about 1 second and then developed at 20° C. for 4 minutes with the internal developing solution B, the maximum density obtained thereby is to show a value at least 5 times, preferably 10 times, that obtained by developing the other portion of said specimen, which has been exposed under the same conditions as above, with the surface developing solution A at 20° C. for 4 minutes.

The silver halide emulsions according to the present invention may be optically sensitized with commonly used sensitizing dyes. Any known combinations of sensitizing dyes used for supersensitization of internal latent image type silver halide emulsions, negative type silver halide emulsions, etc. may be also useful for the purposes of sensitizing the silver halide emulsions of the present invention. For further particulars of the sensitizing dyes, a reference may be made to Research Disclosure No. 15162.

The light-sensitive photographic materials of the present invention, after photographing in the usual way, are subjected to surface development, whereupon direct positive images are readily obtained. That is, the major process of forming direct positive images according to the present invention comprises subjecting, after imagewise exposure, a photographic material having a support and thereon an internal latent image type silver halide emulsion layer of the present invention, the emulsion of which has not previously been fogged, to surface development after fogging treatment and/or while applying the fogging treatment thereto. The fogging treatment to be effected herein may be carried out by means of overall exposure to light or by the use of a fogging agent.

In the present invention, the overall exposure may be carried out by subjecting the imagewise exposed photographic material overall to uniform exposure to light after immersing or swelling in or with a developing solution or other processing solutions. The light source used herein may be any light fallying within the photosensitive wavelength region of the photographic material to be exposed thereto, or irradiation of said material for a short time with a high illumination light, such as flash light, or a relatively long period of time with a weak light. The overall exposure time may be widely varied, according to the photosensitive material to be processed, development treatment conditions to be employed or to the kind of the light source used, so that the best positive image may be eventually obtained.

The fogging agent used in the present invention may include a wide variety of compounds known for, and fogging agent may be present in the system at the time of development treatment. For instance, the fogging agent may be incorporated into any layers constituting a light-sensitive photographic material (of which layers, silver halide emulsion layers are particularly preferred) but excluding a support for said photographic material, or into a developing solution or any processing solution used prior to the development treatment. The fogging agent used may be widely varied according to the purpose for which it is used, and a preferred amount thereof, when incorporated into a silver halide emulsion layer, is 1 to 1500 mg, particularly preferably 10 to 1000 mg, per mole of silver halide. When the fogging agent is incorporated into a processing solution, such as a developing solution or the like, a preferred amount thereof is 0.01 to 5 g/l, particularly preferably 0.05 to 1 g/l.

Usable as fogging agents in the present invention are hydrazines as disclosed, for example, in U.S. Pat. Nos. 2,563,785 and 2,588,982, hydrazide or hydrazone compounds as disclosed in U.S. Pat. No. 3,227,552, heterocyclic quaternary nitrogen salt compounds as disclosed in U.S. Pat. Nos. 3,615,615, 3,718,470, 3,719,494, 3,734,738 and 3,759,901, and acylhydrazinophenylthioureas as disclosed in U.S. Pat. No. 4,030,925, and these fogging agents may be used in combination of two or more. For instance, Research Disclosure No. 15162 discloses the use of a non-adsorption type foggant in combination with as adsorption type foggant.

Illustrative examples of useful fogging agents include hydrazine compounds such as hydrazine hydrochloride, phenylhydrazine hydrochloride, 4-methylphenylhydrazine hydrochloride, 1-formyl-2-(4-methylphenyl)hydrazine, 1-acetyl-2-phenylhydrazine, 1-acetyl-2-(4-acetamidophenyl)hydrazine, 1-methylsulfonyl-2-phenylhydrazine, 1-benzoyl-2-phenylhydrazine, 1-methylsulfonyl-2-(3-phenylsulfonamidophenyl)hydrazine, formaldehyde phenylhydrazine, etc,; N-substituted quaternary cyclammonium salts such as 3-(2-formylethyl)-2-methylbenzothiazorium bromide, 3-(2-formylethyl)-2-propylbenzothiazorium bromide, 3-(2-acetylethyl)-2-benzylbenzoselenazorium chloride, 3-(2-acetylethyl-2-benzyl-5-phenyl-benzooxazorium bromide, 2-methyl-3-[3-(phenylhydrazono) propyl]benzothiazorium bromide, 2-methyl-3-[3-(p-tolylhydrazono) propyl]benzothiazorium bromide, 2-methyl-3-[3-(p-sulfophenylhydrazono)]propyl benzothiazorium bromide, 2-methyl-3-[3-(p-sulfophenylhydrazono)pentyl]benzothiazorium iodide, 1,2-di-hydro-3-methyl-4-phenylpyrido[2,1-b]benzothiazorium bromide, 1,2-dihydro-3-methyl-4-phenylpyrido[2,1-b]-5-phenylbenzooxazorium bromide, 4,4'-ethylenebia(1,2-dihydro-3-methylpyrido[2,1-b]benzothiazorium bromide), 1,2-dihydro-3-methyl-4-phenylpyrido[2,1-b]benzoselenazorium bromide, etc; 5-[1-ethylnaphtho(1,2-b)thiazoline-2-irideneethylidene]-1-(2-phenylcarbazoyl)methyl-3-(4-suldamoylphenyl)-2-thiohydantoin, 5-(3-ethyl-2-benzothiazozolinidene-3-[4-(2-formylhydrazino)phenyl]-rhodanine, 1-[4-(2-formylhydrazino)phenyl-3-phenylthiourea, 1,3-bis[4-(2-formylhydrazino)phenyl]thiourea, and the like.

Light-sensitive photographic materials having silver halide emulsion layers of the present invention form direct positive images by subjecting them, after imagewise exposure, to overall exposure before and/or during surface development or to development treatment in the presence of a fogging agent. The development treatment of light-sensitive photographic materials after imagewise exposure is preferably carried out according to the surface development method, though any development methods may be adoptable therefor. By this surface development method is meant the treatment with a developing solution containing substantially no silver halide solvent.

Usable as developing agents in developing solutions for developing light-sensitive photographic materials of the present invention, are ordinary silver halide developing agents, for example, polyhydroxy benzenes, aminophenols, 3-pyrazolidones, ascorbic acid and its derivatives, reductones, phenylenediamines, or mixtures thereof. Illustrative examples of such developing agents include hydroquinone, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine, diethylamino-o-toluidine, 4-amino-3-methyl-N-ethyl-N-(β-methanesulfonamidoethyl)aniline, 4-amino-3-methyl-N-ethyl-N-(β-hydroxyethyl)aniline, etc. It is also possible that these developing agents are previously incorporated into silver halide emulsions of photosensitive photographic materials so that the thus incorporated developing agents are allowed to act on silver halide when the exposed photographic materials are immersed in aqueous solutions of high pH.

Developing solutions used in the present invention may further contain specific antifoggants and development inhibitors, or alternatively these additives for developing solution can also be incorporated into any constitutive layers of light-sensitive photographic materials. Commonly useful antifoggants include benzotriazoles, for example, 5-methylbenzotriazole, benzimidazoles, benzothiazoles, benzooxazoles, heterocyclic thiones such as 1-phenyl-5-mercaptoterazole, aromatic and aliphatic mercapto compounds, etc. Into the developing solutions, the development accelerators, for example, polyalkylene oxide derivatives or quaternary ammonium salt compounds, can also be contained.

In order to control the surface sensitivity as low as possible in the silver halide emulsions of the present invention and to impart thereto the lowest possible minimum density and highest possible stability in characteristics, the emulsion may be incorporated with commonly used stabilizers, for example, compounds having azaindene rings and mercapto-containing heterocyclic compounds (typical examples thereof include 4-hydroxy-6-methyl-1,3,3a,7-tetrazaindene and 1-phenyl-5-mercaptotetrazole, respectively).

In addition thereto, the silver halide emulsions of the present invention may contain further antifoggants or stabilizers, for example, mercury compounds, triazole type compounds, azaindene type compounds, benzothiazorium type compounds and zinc compounds.

The present silver halide emulsions may be optionally incorporated with a variety of commonly used photographic additives.

Besides the above-mentioned compounds, additive usable according to the purpose for which the present invention is used may include wetting agents, for example, dihydroxyalkanes, film property improving agents, for example, particulate water-dispersible polymeric substances obtained by emulsion polymerization, such as copolymers of alkyl acrylates or alkyl methacrylates and acrylic acid or methacrylic acid, styrene-maleic acid copolymers, styrene-maleic anhydride half alkyl ester copolymers, etc., and coating aids, for example, saponin, polyethylene glycol lauryl ether, etc. Other photographic additives which are optionally usable in the present invention are plasticizing agents, surface active agents, ultraviolet absorbers, pH regulators, antioxidants, antistatic agents, thickeners, graininess improving agents, dyes, mordants, brightening agents, developing speed regulators, matting agents, etc.

Silver halide emulsions as prepared in the above-mentioned manner are coated on a support, if necessary, through a subbing layer, antihalation layer, filter layer, etc. formed on the support and thereby to obtain an internal latent image type light-sensitive silver halide photographic material.

The light-sensitive photographic materials prepared according to the present invention are advantageously usable for color photography and, in this case, the silver halide emulsions are preferably incorporated with couplers for forming cyan, magenta and yellow dye images, respectively. Usable couplers are those which are commonly used in the color photography.

Furthermore, in order to prevent dye images from fading caused by actinic rays of short wavelength, the use of ultraviolet absorbers, for example, thiazolidone, benzotriazole, acrylonitrile or benzophenone type compounds, is of advantage, and the use of Tinuvin PS, 320, 326, 327 and 328 (these are each products of Ciba-Geigy), either singly or in combination, is particularly of advantage.

As supports for the light-sensitive photographic materials of the present invention, any appropriate mateials are usable, typical of which are polyethyleneterephalate films, polycarbonate films, polystyrene films, polypropylene films, cellulose acetate films, glass plates, bartya papers and polyethylene-laminated papers, and these supports may be subbed previously, if necessary.

In the silver halide emulsions of the present invention, there may be used, according to the purpose for which they are used, suitable gelatin derivatives as protective colloids or binders in addition to gelatin. Suitable gelatin derivatives may include, for example, acylated gelatin, guanidylated gelatin, carbamylated gelatin, cyanoethanolated gelatin, esterified gelatin, etc.

In the present invention, according to the purpose of which it is used, constitutive layers of the present light-sensitive silver halide photographic material, such as emulsion layers, intermediate layers, protective layers, filter layers, backing layers, etc., may be incorporated with hydrophilic binders other than those illustrated above. Usable as the hydrophilic binders in addition to gelatin, are colloidal albumin, agar, gum arabic, dextran, alginic acid, cellulose derivatives such as cellulose acetate hydrolyzed to the acetyl content of 19–20%, polyacrylamides, imidated polyacrylamides, casein, vinyl alchol polymers containing urethanecarboxylic acid groups or cyanoacetyl groups such as vinyl alcohol-vinyl aminoacetate copolymers, polyvinyl alcohol, polyvinyl pyrolidone, hydrolyzed polyvinyl acetate, polymers obtained by polymerization of protein or saturated acylated protein and monomers having vinyl groups, polyvinyl pyridine, polyvinyl amines, polyaminoethyl methacrylates, polyethylene amines, etc. These hydrophilic binders may be incorporated, according to the purpose, with suitable plasticizers, lubricants, etc.

The constitutive layers of the light-sensitive photographic material of the present invention may be hardened with any suitable hardeners. The suitable hardeners include chrome salts, zirconium salts, aldehyde or halotriazine type hardeners such as formaldehyde or mucohalogeno acid, polyepoxy compounds, ethyleneimine, vinylsulfone or acryloyl type hardeners.

The light-sensitive photographic materials of the present invention can be provided on the support thereof with a wide variety of photographic constitutive layers such as emulsion layers, filter layers, intermediate layers, protective layers, subbing layers, backing layers, antihalation layers, etc.

The light-sensitive photographic materials thus prepared according to the present invention are effectively applicable to a variety of uses in general black-and-white, X-ray, color, pseudocolor, printing, infrared ray, micro, silver dye bleach or the like photographic techniques. The present light-sensitive photographic materials are also applicable to the colloid transfer process, silver salt diffusion transfer process, such color image transfer process and color diffusion transfer process as disclosed in U.S. Pat. Nos. 3,087,817, 3,185,567 and 2,983,606 to Rogers, 3,253,915 to Weiyerts et al., 3,227,550 to Whitemore et al., 3,227,551 to Pearl et al., and Nos. 3,415,644, 3,415,645 and 3,415,646 to Land.

By virtue of the use of silver halide emulsions of the present invention, positive images having the best possible improved photographic efficiencies, and core grains used in said emulsions are readily prepared according to the aforesaid conversion process, wherein the covering of shells over the core grains can be completed in a short time. Furthermore, the excellent photographic characteristics of the present silver halide emulsions as attained are considered to appear as a result of cooperative action among respective characteristics of silver halide of the core and of the shell and the core/shell structure originated from the combination of said core and said shell.

The present invention is illustrated below with reference to examples.

EXAMPLE 1

A conversion type emulsion are prepared in the following manner (Emulsion-1). Into a solution containing 10 g of gelatin, while controlling the temperature so as to be maintained at 60° C., were simultaneously incorporated portionwise for 10 minutes 175 ml of an aqueous 2 molar solution of silver nitrate and 175 ml of an aqueous 2.1 molar solution of potassium chloride. After physical ripening for 10 minutes, the resulting mixture was incorporated with 200 ml of an aqueous 2 molar solution of potassium bromide, followed by physical ripening for additional 10 minutes. Subsequently the mixture was washed with water to remove water-soluble salts therefrom, followed by addition thereto of 10 g of gelatin, and then made up to 500 ml with the addition of water., There was obtained a silver chlorobromide emulsion, the silver halide grains of which has an average particle diameter of 0.3μ (the emulsion as analyzed was found to contain 96 mol % of silver bromide).

EXAMPLE 2

A core/shell emulsion was prepared in the following manner using the conversion type emulsion prepared in Example 1 as core grains.

Into 500 ml of a core emulsion (Emulsion-1) were simultaneously incorporated portionwise at 60° C. for 5 minutes 100 ml of an aqueous 2 molar solution of silver nitrate and 100 ml of an aqueous 2.1 molar solution of potassium chloride, thereby precipitating silver chloride shells, followed by water washing. There was obtained a core/shell emulsion (Emulsion-2-1), the core/shell grains of which had an average diameter of 0.35μ, and the silver chloride shell content in the core/shell grains of which was 36 mols % based on the sum total of silver halides in said core/shell emulsion. Similarly, into 500 ml of a core emulsion (Emulsion-1) were simultaneously incorporated portionwise at 60° C. for 10 minutes 100 ml of an aqueous 2 molar solution of silver nitrate and 100 ml of an aqueous 2.05 molar solution of potassium bromide; thereby precipitating silver bromide shells, followed by water-washing. There was obtained a core/shell emulsion (Emulsion 2-2), the core/shell particles of which had an average diameter of 0.37μ, and the silver bromide shell content in the core/shell grain of which was 36 mols % based on the sum total of silver halides in said core/shell emulsion.

Further, according to the procedure disclosed in Example 1 of U.S. Pat. No. 3,935,014, on a silver bromide core (12.5 mol % based on the sum total of silver halides) was precipitated a silver chloride layer (8.75 mol % on the same basis as above) and then on the silver chloride layer was laminated a shell of silver bromide layer (78.75 mol %) to prepare a core/shell emulsion, the silver halide grains of which had an average diameter of 0.4μ (Emulsion-3).

EXAMPLE 3

Into 220 ml of an aqueous 1 molar solution of potassium chloride containing 10 g of gelatin was quickly incorporated at 60° C. 200 ml of an aqueous 1 molar solution of silver nitrate. Into the resulting solution, after physical ripening for 10 minutes, was incorporated a mixture comprising 200 ml of an aqueous 1 molar solution of potassium bromide and 50 ml of an aqueous 0.1 molar solution of potassium iodide. To the resulting mixture was added portionwise for 5 minutes 150 ml of an aqueous 1 molar solution of silver nitrate in order to precipitate silver chloride shells on the conversion type silver chloroiodobromide particles as formed in the preceding stage and the mixture was subjected to physical ripening for 20 minutes, followed by water-washing, to obtain an emulsion (Emulsion-4).

EXAMPLE 4

The emulsions as prepared in the foregoing Examples 1–3, respectively, were individually incorporated with a suitable coating aid and hardener and then coated at a silver coverage of 35 mg/100 cm$^2$ on a cellulose acetate film support, followed by drying.

Using a sensitometer, the samples thus prepared were exposed through an optical wedge for sensitometry (hereinafter this exposure called "wedge exposure") and then developed at 20° C., for 4 minutes with a developing solution as prescribed below, followed by fixing, washing and drying.

| | |
|---|---|
| Phenidone | 0.4 g |
| Sodium sulfite (anhydrous) | 75 g |
| Hydroquinone | 10 g |
| Sodium carbonate (monohydrate) | 40 g |
| Potassium bromide | 4 g |
| 5-Methylbenzotriazole | 10 mg |
| 1-Acetyl-2-phenylhydrazine (fogging agent) | 0.1 g |
| Water to make | 1 liter |

(pH was adjusted to 12.5 with sodium hydroxide.)

The positive images obtained were measured in speed, maximum density and minimum density to obtain the results as shown in Table 1. In that case, however, the images were compared in speed with one another by reference to the reciprocal value of the exposure amount capable of giving a density of (maximum density + minimum density)/2, and the relative speed was represented by a relative value as measured by assuming as 100 the speed of Emulsion-1.

TABLE 1

| Sample No. | Emulsion | Relative speed | Maximum density | Minimum sensity |
|---|---|---|---|---|
| 1 (Comparative-1) | Emulsion-1 | 100 | 0.63 | 0.18 |
| 2 | Emulsion-2-1 | 400 | 0.95 | 0.08 |
| 3 | Emulsion-2-2 | 330 | 0.83 | 0.07 |
| 4 | Emulsion-4 | 420 | 0.91 | 0.07 |
| 5 (Comparative-2) | Emulsion-3 | 240 | 0.50 | 0.12 |

The results shown in Table 1, it is understood that when compared with the conversion type emulsion (Emulsion-1), the emulsions of the present invention prepared by covering said conversion type emulsion with various shells in accordance with the invention had favorable characteristics such as high speed, high maximum density and low minimum density.

Comparing with the conventionally known core/-shell emulsion (Emulsion-3), moreover, it is understood that the present emulsions are apparently superior to Emulsion-3 even when judged from the ratio of speed of maximum density/minimum density.

EXAMPLE 5

The emulsions as prepared in Examples 1–3 were incorporated individually with a sensitizing dye of the following formula.

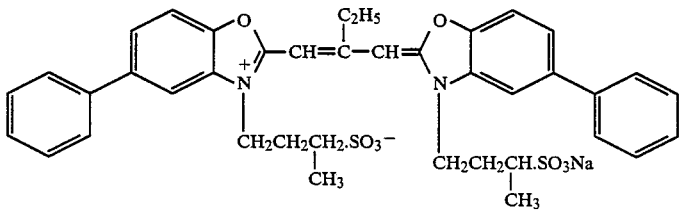

Separately, a solution of a magenta coupler, 1-(2,4,6-trichlorophenyl)-3-(2-chloro-5-octadecylsuccinimidoanilino)-5-pyrazoline, dissolved in a mixture of dibutyl phthalte and ethyl acetate was dispersed in an aqueous gelatin solution to prepare a coupler dispersion.

Subsequently the coupler dispersion thus prepared was incorporated into each of the emulsions mentioned above, followed by mixing and adding a hardener, and the resulting emulsion was coated at a silver coverage of 20 mg/100 $cm^2$ on a cellulose acetate film support and then dried.

Each of the samples thus prepared was subjected to wedge exposure through a yellow filter and then developed at 20° C. for 5 minutes with a developing solution as prescribed below.

| | |
|---|---|
| 4-Amino-3-methyl-N—ethyl-N—(β-methanesulfonamidoethyl)aniline sulfate | 5 g |
| Sodium sulfite (anhydrous) | 2 g |
| Sodium carbonate (monohydrate) | 15 g |
| Potassium bromide | 1 g |
| Benzyl alcohol | 10 ml |
| Water to make | 1 liter |

In the course of the above development, however, the sample was uniformly exposed on the whole surface to white light of 1 lux. The developed sample was subjected to bleaching, fixing and washing, respectively, in the usual way and then dried. The magenta positive images respectively obtained on the samples thus processed were measured according to the procedure of Example 4 to obtain the results as shown in Table 2.

TABLE 2

| Sample No. | Emulsion | Relative Speed | Maximum density | Minimum density |
|---|---|---|---|---|
| 6 (Comparative-3) | Emulsion-1 | 100 | 1.85 | 0.25 |
| 7 | Emulsion-2-1 | 600 | 2.05 | 0.10 |
| 8 | Emulsion-2-2 | 500 | 1.97 | 0.09 |
| 9 | Emulsion-4 | 600 | 2.02 | 0.10 |
| 10 (Comparative-4) | Emulsion-3 | 340 | 1.53 | 0.19 |

EXAMPLE 6

Core/shell emulsions were prepared according to the procedures described in Example 2 employed for the preparation of Emulsion-2-1 and Emulsion-2-2, respectively, except that the amount of potassium chloride or porassium bromide used in each emulsion was adjusted so that the content, based on the sum total of silver halides, of the silver halide in each shell may amount to the value as indicated in Table 3.

TABLE 3

| | Silver halide content in shell (mol %) | | | | | |
|---|---|---|---|---|---|---|
| | 10 | 20 | 30 | 40 | 50 | 70 |
| AgCl—shell | Emulsion-5 | Emulsion-6 | Emulsion-7 | Emulsion-8 | Emulsion-9 | Emulsion-10 |
| AgBr-shell | Emulsion-11 | Emulsion-12 | Emulsion-13 | Emulsion-14 | Emulsion-15 | Emulsion-16 |

Further, a core/shell emulsion (Emulsion-17) was prepared according to the procedure disclosed in Example 4 of U.S. Pat. No. 3,761,266, in which a silver bromide core (10 mols %) was covered by a silver chloride shell (90 mols %).

Each of the emulsions thus prepared was incorporated with the magenta coupler used in Example 5, and the resulting emulsion was charged with a hardener and coated at a silver coverage of 20 mg/100 $cm^2$ on a cellulose triacetate film support and then dried.

Separately, a sample for comparison was prepared using the emulsion (Emulsion-1) prepared in Example 1 under the same conditions as mentioned above.

The samples thus prepared were individually subjected to the following treatments. That is, each sample was stored for one day at 20° C. and 55% RH (Condition-1), for 2 days at 55° C. and 10% RH (Condition-2) and for 2 days at 55° C. and 80% RH, respectively, and thereafter was developed at 33° C. for 3 minutes with a developing solution as prescribed below, followed by bleaching, fixing and water-washing, and then dried. The positive images respectively obtained on the samples thus processed were measured according to the procedure described in Example 4 to obtain the results as shown in Table 4. In the table, the speed was represented by a relative value as measured by assuming as 100 the speed of sample No. 11.

| | |
|---|---|
| 4-Amino-3-methyl-N—ethyl-N—(β-methanesulfonamidoethyl) aniline sulfate | 5 g |
| Sodium sulfite (anhydrous) | 2 g |
| Sodium carbonate (monohydrate) | 15 g |
| Potassium bromide | 1 g |
| 5-Methyl-benzotriazole | 10 mg |
| 1-Formyl-2-(4-methylphenyl) hydrazine (fogging agent) | 0.1 g |

-continued

| Water to make | 1 liter |
|---|---|

Adjusted pH to 11.5 with sodium hydroxide)

From the results shown in Table 4, it is shown that the samples prepared by the use of the emulsion (Emulsions 5–10 and Emulsions 11–14) of the present invention are found to have been markedly improved in storage stability. That is, of the comparative emulsions, (Emulsion-1) shows a marked increase in minimum density when stored under Condition-2, and shows a marked decrease in maximum density when stored under Condition-3, and thus the sample contained (Emulsion-1) is very poor in storage stability. Further, (Emulsion-17) is high in minimum density and thus is of little practical use. On the other hand, emulsions are improved in storage atability by virtue of the coating of silver halide shell, and the stabilization effect becomes prominent with increasing the silver halide content in the shell.

TABLE 4

| Sample No. | Emulsion | | Condition-1 | Condition-2 | Condition-3 |
|---|---|---|---|---|---|
| 11 (Comparative-5) | Emulsion-1 | Relative speed | 100 | 55 | 70 |
| | | Maximum density | 1.35 | 1.44 | 0.95 |
| | | Minimum density | 0.15 | 0.35 | 0.19 |
| 12 | Emulsion-5 | Relative speed | 390 | 260 | 310 |
| | | Maximum density | 1.67 | 1.72 | 1.47 |
| | | Minimum density | 0.13 | 0.21 | 0.16 |
| 13 | Emulsion-6 | Relative speed | 440 | 350 | 375 |
| | | Maximum density | 1.79 | 1.83 | 1.68 |
| | | Minimum density | 0.11 | 0.17 | 0.12 |
| 14 | Emulsion-7 | Relative speed | 580 | 520 | 550 |
| | | Maximum density | 1.95 | 1.99 | 1.88 |
| | | Minimum density | 0.08 | 0.11 | 0.09 |
| 15 | Emulsion-8 | Relative speed | 670 | 630 | 645 |
| | | Maximum density | 2.01 | 2.05 | 1.93 |
| | | Minimum density | 0.07 | 0.10 | 0.08 |
| 16 | Emulsion-9 | Relative speed | 750 | 720 | 730 |
| | | Maximum density | 1.75 | 1.79 | 1.69 |
| | | Minimum density | 0.07 | 0.09 | 0.08 |
| 17 | Emulsion-10 | Relative speed | 750 | 725 | 730 |
| | | Maximum density | 1.51 | 1.55 | 1.48 |
| | | minimum density | 0.07 | 0.09 | 0.08 |
| 18 | Emulsion-11 | Relative speed | 350 | 265 | 280 |
| | | Maximum density | 1.39 | 1.45 | 1.01 |
| | | Minimum density | 0.14 | 0.22 | 0.17 |
| 19 | Emulsion-12 | Relative speed | 390 | 310 | 330 |
| | | Maximum density | 1.56 | 1.61 | 1.41 |

TABLE 4-continued

| Sample No. | Emulsion | | Condition-1 | Condition-2 | Condition-3 |
|---|---|---|---|---|---|
| | | Minimum density | 0.11 | 0.18 | 0.14 |
| 20 | Emulsion-13 | Relative speed | 485 | 450 | 460 |
| | | Maximum density | 1.81 | 1.84 | 1.75 |
| | | Minimum density | 0.08 | 0.12 | 0.11 |
| 21 | Emulsion-14 | Relative speed | 610 | 575 | 580 |
| | | Maximum density | 1.87 | 1.91 | 1.79 |
| | | Minimum density | 0.08 | 0.11 | 0.11 |
| 22 | Emulsion-15 | Relative speed | 665 | 630 | 635 |
| | | Maximum density | 1.69 | 1.70 | 1.65 |
| | | Minimum density | 0.07 | 0.11 | 0.11 |
| 23 | Emulsion-16 | Relative speed | 670 | 630 | 640 |
| | | Maximum density | 1.43 | 1.45 | 1.39 |
| | | Minimum density | 0.07 | 0.10 | 0.11 |
| 24 (Comparative-6) | Emulsion-17 | Relative speed | 65 | 30 | 35 |
| | | Maximum density | 2.19 | 2.35 | 1.63 |
| | | Minimum density | 0.93 | 1.41 | 1.16 |

EXAMPLE 7

Following the procedure described in Example 1, conversion type silver chlorobromide emulsions were prepared as in the following, except that the amount of potassium bromide to be added for forming silver bromide was varied in the manner as indicated in the following table.

| Emulsion | Amount of KBr added (mol % based on Ag) | Content of AgBr (mol %) (chemical analysis value) |
|---|---|---|
| A | 50 | 50 |
| B | 80 | 80 |
| C | 100 | 96 |
| D | 120 | 96 |

Subsequently, using emulsions A-D (core emulsions) prepared above, silver chloride-coated core/shell emulsions were prepared according to the procedure described in Example 2 (the molar ratio of core/shell in each emulsion was adjusted so as to become 65/35).

The emulsions which had been incorporated with the magenta coupler used in Example 2 and with a hardener were individually coated at a silver coverage of 20 mg/100 $cm^2$ on a cellulose triacetate film support and then dried to prepare samples. The samples were then developed under the same conditions as in Example 5 and subjected to sensitometry to obtain the results as shown in Table 5.

TABLE 5

| Sample No. | Core Emulsion (AgBr content, mol %) | Core/shell Ratio (mole ratio) | Relative Speed | Maximum density | Minimum density |
|---|---|---|---|---|---|
| 25 | A (50) | 65/35 | 150 | 1.83 | 0.19 |
| 26 | B (80) | 65/35 | 330 | 1.89 | 0.10 |
| 27 | C (96) | 65/35 | 470 | 1.91 | 0.07 |
| 28 | D (96) | 65/35 | 500 | 1.89 | 0.07 |

From a comparison among samples Nos. 25–28 shown in Table 5, it is understood that the speed decreases and minimum density increases as the AgBr content in the core emulsion grain decreases.

EXAMPLE 8

The emulsion-2-1 as prepared in Example 2 was divided into three portions, one of which was optically sensitized with the following dyes [I] and [II] to prepare a green-sensitive emulsion, another of which was sensitized with the following dyes [III] and [IV] to prepare a red-sensitive emulsion, and the remainder portion was used as a blue-sensitive emulsion without optical sensitization.

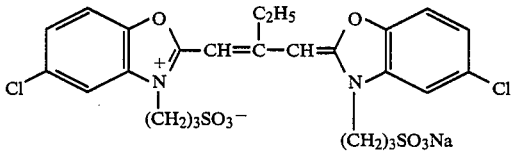

[I]

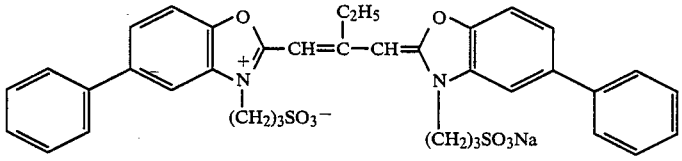

[II]

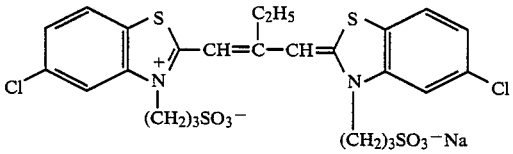

[III]

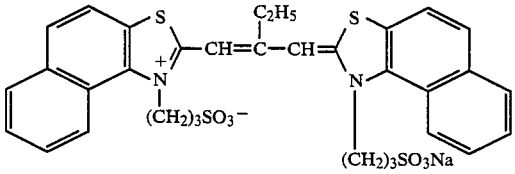

[IV]

On a resin-coated paper support, the following layers were coated one after another.

(1) Red-sensitive layer

The layer contains the above-mentioned red-sensitive emulsion and an oil-protect dispersed cyan coupler 2,4-dichloro-3-methyl-6-[α-(2,4-di-tert-amylphenoxy)-butylamido]phenol.

(2) Intermediate layer

The layer contains a grey colloid silver and an oil-protect dispersed 2,5-di-tert-octylhydroquinone.

(3) Green-sensitive layer

The layer contains the above-mentioned green-sensitive emulsion and an oil-protect dispersed magenta coupler 1-(2,4,6-trichlorophenyl)-3-(2-chloro-5-octadecylsuccinimidoanilino)5-pyrazolone.

(4) Yellow filter layer

The layer contains a yellow colloid silver and an oil-protect dispersed 2,5-di-tert-octylhydroquinone.

(5) Blue-sensitive layer

The layer contains the above-mentioned blue-sensitive emulsion and an oil-protect dispersed yellow coupler α-[4-(1-benzyl-2-phenyl-3,5-dioxo-1,2,4-triazolydinyl)]-α-pivaryl-2-chloro-5-[γ-(2,4-di-tert-amylphenoxy)butylamido]acetanilide.

(6) Protective layer

The sample after drying was subjected to wedge exposure and then developed and processed under the same conditions as in Example 5. As the result, there was obtained a favorable color positive image.

EXAMPLE 9

A photosensitive element was prepared by coating on a transparent polyethylene terephthalate film support the following layers one after another.

(1) Image-receiving layer comprising a 1:1 copolymer of styrene and N-vinylbenzyl-N,N,N-trihexylammonium chloride, and gelatin.

(2) Light reflecting layer comprising titanium dioxide and gelatin.

(3) Opacifying layer comprising carbon black and gelatin.

(4) Dye releasing compound-containing layer comprising magenta dye releasing compounds 1-hydroxy-4-[3-{α-(2-methoxy-5-sulfamoyl-1-azo)-4-hydroxy-1-naphthoxy)ethylcarbonyl}phenylsulfonamido]-N-(δ-2,4-di-tert-amylphenoxybutyl)-2-naphthamide, N,N-diethyllaurylamide, and gelatin.

(5) Photosensitive layer comprising Emulsion-2-1 as prepared in Example 2, 1-formyl-2-(4-methylphenyl)hydrazine, and gelatin.

(6) Gelatinous protective layer comprising mucochloric acid.

Separately, a processing sheet was prepared by coating on a transparent polyethylene terephthalate film support the following layers one after another.

(1) Neutralization layer comprising a copolymer of acrylic acid and ethyl acrylate.

(2) Timing layer comprising cellulose diacetate.

Subsequently, the above-mentioned photosensitive element was subjected to wedge exposure, and thereafter the processing sheet was placed upon the exposed photosensitive element and further a pod containing the following processing composition was affixed to therebetween to prepare a film unit.

The film unit thus prepared was then passed through between a pair of rollers compressedly juxtaposed with an definite space to rupture the pod, thereby spreading the contents of the pod over between the photosensitive element and processing sheet.

| Processing composition: | |
|---|---|
| Potassium hydroxide | 56 g |
| Sodium sulfite | 2 g |
| 4-Hydroxymethyl-4-methyl-1-phenyl-3-pyrazolidone | 8 g |
| 5-Methylbenzotriazole | 2.8 g |
| Carbon black (RaVen-450 by Columbia Carbon Co.) | 150 g |
| Carboxymethylcellulose sodium salt (High Viscosity type, produced by Tokyo Kasei K.K.) | 50 g |
| Benzyl alcohol | 1.5 ml |
| Water to make | 1 liter |

After three minutes, a magenta dye image was observed through the transparent support of the photosensitive element. Thus, it is understood that the emulsions of the present invention are applicable to the color diffusion transfer process, as well.

What we claim is:

1. A process for forming a direct positive image, said process comprising subjecting a silver halide photographic material to (i) imagewise exposure and (ii) overall exposure before and/or during development, or surface development in the presence of a fogging agent, wherein the silver halide photographic material comprises a support and at least one silver halide emulsion layer comprising internal image type silver halide grains, each grain having a core/shell type structure comprising a conversion type silver halide core and a silver halide shell on said core, said grains not being previously fogged, the silver halide content of said shell being 30 to 40 mole percent based upon the total silver halide in said core and said shell.

2. The process of claim 1 wherein said conversion type silver halide core contains at least 80 mole percent of silver bromide and less than 10 mole percent of silver iodide.

3. The process of claim 1 wherein said conversion type silver halide core contains at least 90 mole percent of silver bromide and less than 5 mole percent of silver iodide.

4. The process of claim 1 wherein said silver halide emulsion layer contains a coupler.

5. The process of claim 1 wherein the surface of said shell is not chemically sensitized, and the silver halide emulsion layer coated on a support when exposed for a given time up to 1 second and then developed at 20° C. for 4 minutes with internal developing solution B, would produce a maximum density which is at least 5 times that which is obtained when developing said layer similarly exposed and then developed at 20° C. for 4 minutes with surface developing solution A.

| Composition of the developing solution A: | |
|---|---|
| Methol | 2.5 g |
| l-Ascorbic acid | 10 g |
| $NaBO_2.4H_2O$ | 35 g |
| KBr | 1 g |
| Water to make | 1 liter |
| **Composition of the internal developing solution B:** | |
| Methol | 2 g |
| Sodium sulfite (anhydrous) | 90 g |
| Hydroquinone | 8 g |
| Sodium carbonate | 52.5 g |
| KBr | 5 g |
| KI | 0.5 g |
| Water to make | 1 liter |

* * * * *